United States Patent [19]

Wilson

[11] Patent Number: 4,638,995

[45] Date of Patent: Jan. 27, 1987

[54] EXERCISE CHAIR

[76] Inventor: Jerry L. Wilson, 485 NW. 170th Dr., Beaverton, Oreg. 97005

[21] Appl. No.: 694,950

[22] Filed: Jan. 25, 1985

[51] Int. Cl.[4] ..... A63B 23/02

[52] U.S. Cl. ..... 272/144; 272/143; 272/62; 297/457

[58] Field of Search ..... 272/93, 116, 143, 134, 272/144, DIG. 4, 109, 62, 63, 145; 128/33; 297/1, 3, 69, 422, 457, 423, 19, 20, 29, 38, 45, 57, 68, 70, 92, 283, 370, 429, 430, 431, 432, 435, 440; D6/353-368, 334, 342

[56] References Cited

U.S. PATENT DOCUMENTS

| | | | |
|---|---|---|---|
| D. 216,721 | 3/1970 | Sassenberg | D34/5 |
| 217,918 | 7/1879 | White | 272/144 |
| 2,738,001 | 3/1956 | Drabert | 297/423 |
| 3,709,487 | 1/1973 | Walker | 272/144 |
| 3,857,561 | 12/1974 | Cecchettini et al. | 272/144 |
| 4,336,934 | 6/1982 | Hanagan et al. | 272/134 X |
| 4,341,378 | 7/1982 | Agyagos | 272/62 |
| 4,358,109 | 11/1982 | Schrems | 272/144 |

FOREIGN PATENT DOCUMENTS

| | | | |
|---|---|---|---|
| 446443 | 4/1936 | United Kingdom | 297/19 |

*Primary Examiner*—Richard J. Apley
*Assistant Examiner*—John Welsh
*Attorney, Agent, or Firm*—Chernoff, Vilhauer, McClung & Stenzel

[57] ABSTRACT

An exercise chair. Two frame members are held in parallel, spaced apart positions by three rigid transverse connecting members disposed proximate one end serving as the back of the chair. A fabric seat is disposed between the frame members, the seat being detachably held in place by one of the connecting members and by transverse bars resting against the frame members. Extensions are provided at the bottoms of the frame members for varying their length from the back to the front of the chair, shafts being provided on the extensions for use as legs and footrests or, alternatively, hand grips for exercises. With the seat removed the chair can be used to perform push-up and sit-up type exercises, and can be placed on its back to perform dip and chip-up type exercises with the extensions extended and locked in place. The chair can also be used for conventional weightlifting.

13 Claims, 13 Drawing Figures

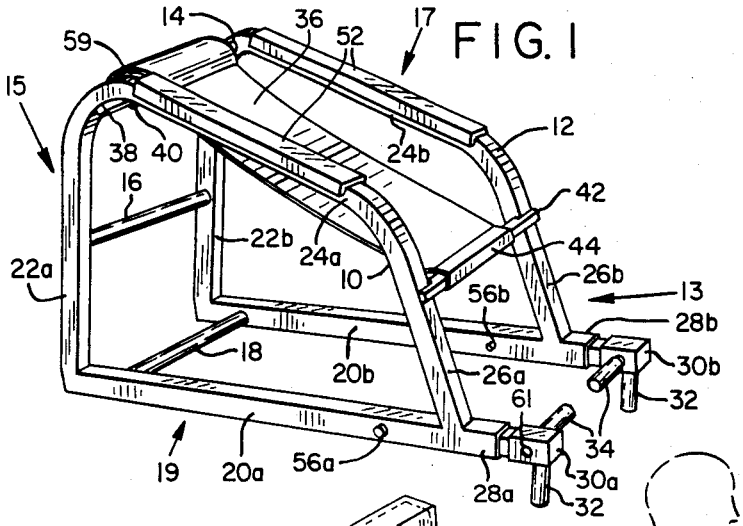
FIG. 1
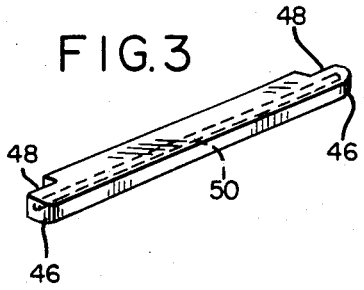
FIG. 3
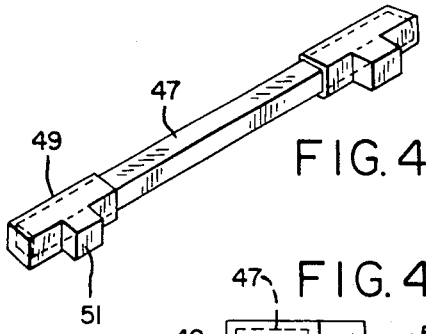
FIG. 4(a)
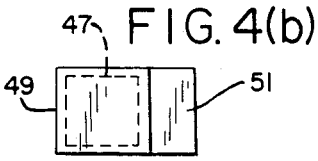
FIG. 4(b)
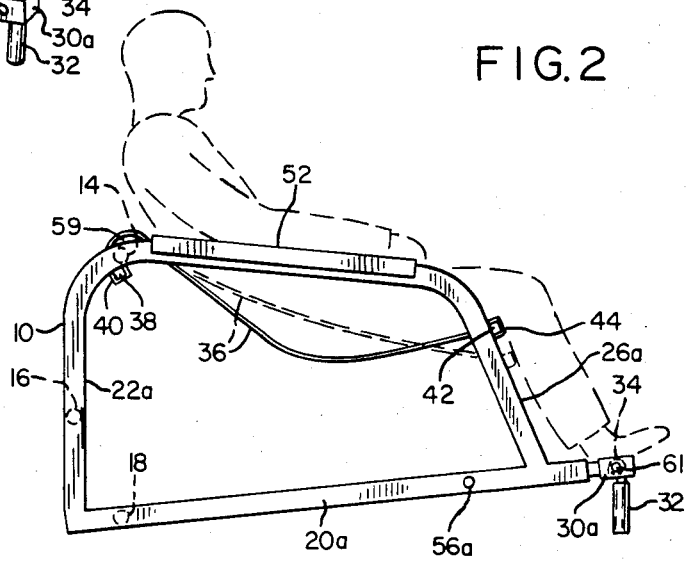
FIG. 2
FIG. 5
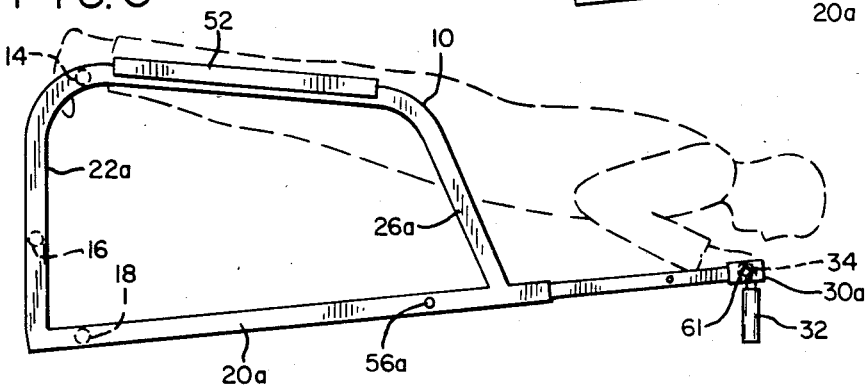
FIG. 6
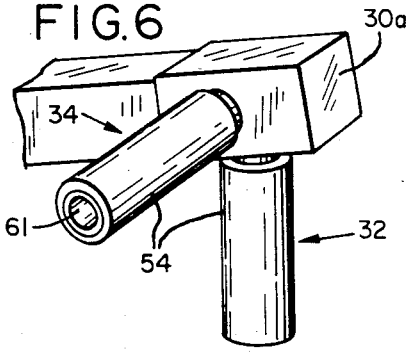
FIG. 7
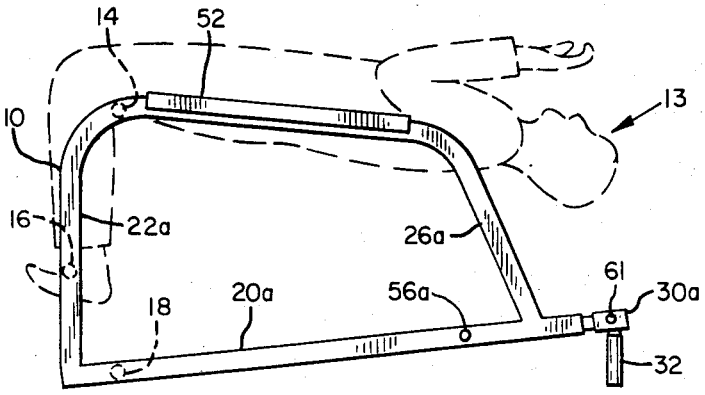

FIG. 8
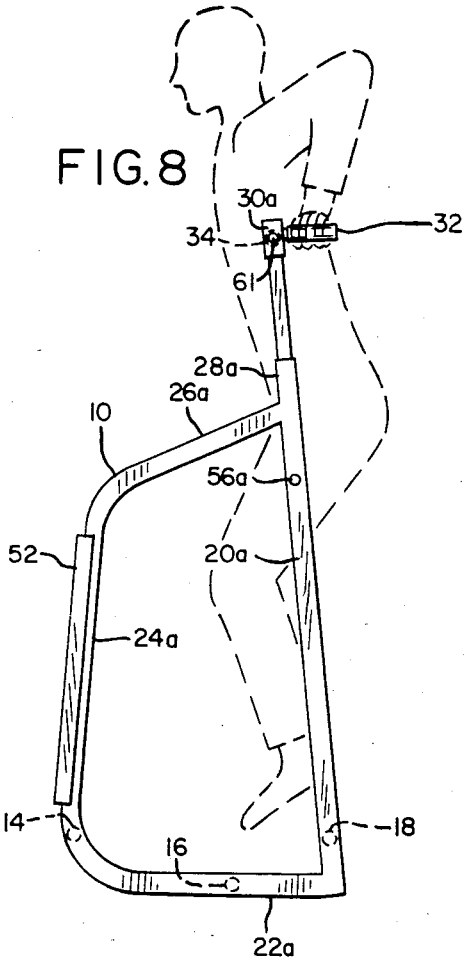
FIG. 9
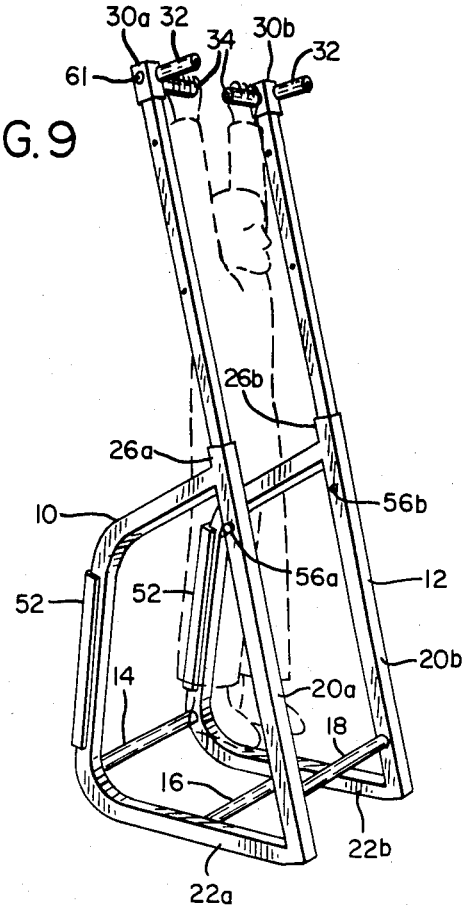
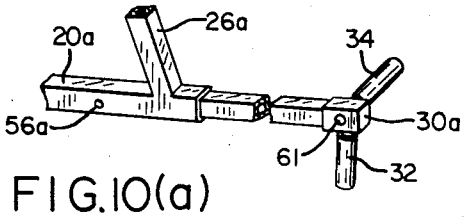
FIG. 10(a)
FIG. 10(b)
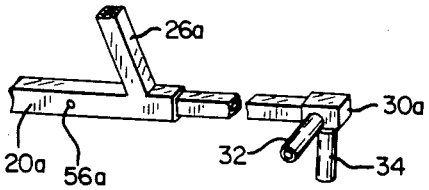
FIG. 11
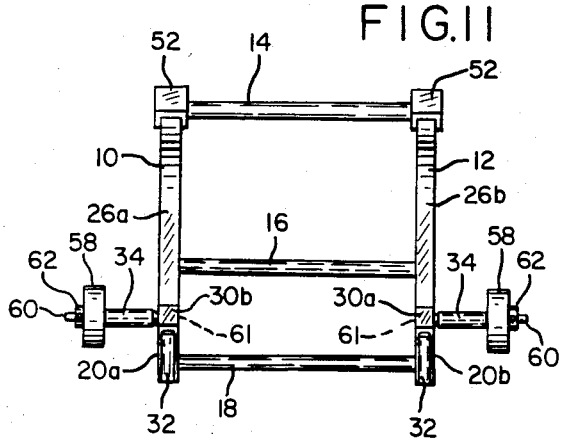

EXERCISE CHAIR

BACKGROUND OF THE INVENTION

This invention relates to exercise apparatus, and particularly to an exercise chair.

There has been a trend toward increased attention to and popularization of physical fitness. One aspect of physical fitness is the improvement of muscle tone and strength, which can be and often is facilitated with the assistance of mechanical apparatus such as machines involving weights and resilient members. While many athletic clubs and other institutions provide weightlifting and other exercise apparatus, there is a need for apparatus which can be used at home in order to save time and money, and to allow exercise to be obtained at a convenient time. There is also a need to perform such exercise safely, and it is of course important to perform effectively a variety of exercises suited to overall body development. It is therefore desirable to have an exercise apparatus that facilitates the performance of muscle strengthening and toning exercises yet fits aesthetically in the home environment, takes no extra space, provides an effective set of balanced exercises, and is sufficiently inexpensive that individuals can afford to purchase it.

Previously known exercise apparatus generally fall into several categories. There are exercise apparatus which primarily employ moving members to displace weights or other resilient members. Examples of such apparatus are disclosed in Kulkens U.S. Pat. No. 3,638,941; Kulkens U.S. Pat. No. 3,902,717; LaLanne U.S. Pat. No. 3,647,209; Louvet French Pat. No. 1,420,610; White U.S. Pat. No. 217,918; Friedli U.S. Pat. No. 1,114,458; and Wilson U.S. Pat. No. 4,072,309. Some of the drawbacks of various apparatus of this type are that they employ resistance other than the user's own body weight, they emphasize primarily upper body exercises, they employ parts that are subject to failure because they are moving parts, they take up space that must be dedicated to an exercise apparatus, and they look like a machine.

There are multi-position, basically passive, devices which assist a person in performing a limited number of exercises, but which look like exercise apparatus and require dedicated space. Examples of these are shown in Delinger U.S. Pat. No. 3,545,748 and Schrems U.S. Pat. No. 4,358,109.

There are fold-up, basically passive, apparatus which allow the performance of a number of different exercises and fold into a form which reduces the space that they employ when not in use and changes their appearance so as to be less obtrusive. Examples of these are shown in Lloyd U.S. Pat. No. 3,664,666; Agyagos U.S. Pat. No. 4,341,378; and Walker U.S. Pat. No. 3,709,487. In such apparatus the emphasis in the folded up position is on hiding the apparatus or putting it in a less obtrusive form, rather than employing the apparatus in a useful way. Thus, for example, while the device in Walker folds into a form resembling a chair, the shape of the chair is not adapted for relaxation since it requires one to sit with a rigid, upright posture.

In addition, there are specialty items for specific types of exercising, such as the devices shown in Andrews U.S. Pat. No. 3,731,921 and Sassenberg U.S. Pat. Des. No. 216,721.

Accordingly, there is a need for an improved exercise apparatus that can be utilized at home both as an exercise apparatus and as a useful and aesthetically pleasing piece of furniture so as to provide a facility for an effective set of exercises without taking up additional space. There is also a need for such an apparatus that increases exercise safety by providing resistance based primarily upon the user's own body weight.

SUMMARY OF THE INVENTION

The present invention overcomes the aforementioned drawbacks of prior art exercise apparatus and meets the need for an improved home exercise apparatus by providing novel exercise chair. The exercise chair enables one to perform an effective set of exercises based upon resistance provided by the user's own body weight. It employs no parts that are required to move during exercising. It also functions very well as a comfortable and aesthetically pleasing chair particularly adapted for relaxation during and following exercise.

The chair employs a pair of rigid frame members disposed parallel to one another and rigidly interconnected by three transverse members. The frame members each form a loop which provides a base and arm rest for the user, as well as support for a seat. The seat is made of a sheet of fabric supported between the two frame members, which permits air readily to reach the body of the person sitting in the chair following exercise, and is adjustable for contour. The seat may be adjusted to allow the user to assume a semi-supine position so as to lower the user's center of gravity for increased comfort. The back of the seat may be equipped with a head cushion, and the front of the chair is provided with footrests.

As an exercise apparatus the chair may be used in several modes. In a "sit-up" mode the interconnecting members between the two frame members provide support and leverage for the user in doing sit-ups. In a "push-up" mode the footrests provide hand grips and the interconnecting tubes provide foot supports which allow the user to push against selected amounts of the user's own body weight. In "chin-up" and "dip" modes the chair is placed on its back. Integral extensions are disposed upwardly above the floor surface so that the footrests may be used as hand grips for performing chin-ups or for performing dips. The extensions may be rotated about their elongate axes for performing wide or narrow chin-ups. The seat of the chair is conveniently removable so that, in all of these modes, the exercises may be performed with the body of the user disposed between the two frame members.

In addition, the chair may be placed in a lifting mode where the weight of the chair provides some resistance. In this mode the chair may be used, for example, to assist the user in performing knee bending exercises, the large majority of the resistance being provided by the user's own body weight. While the principal emphasis of the exercise chair is on the use of one's own body weight for resistance, weights may be added to the chair in this mode to provide considerably greater resistance.

Accordingly, it is a principal object of the present invention to provide a novel exercise device that also functions as a useful piece of furniture in the home.

It is a further object of the present invention to provide an exercise device which not only enables one to perform effectively multiple exercises, but also functions well as a chair.

It is another object of the invention to provide an exercise device which enables one to perform an effective set of exercises employing only one's own body weight as resistance.

It is yet a further object of the present invention to provide an exercise chair that is durable.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of an embodiment of an exercise chair according to the present invention.

FIG. 2 is a side view of the exercise chair embodiment of FIG. 1 showing a person seated therein.

FIG. 3 is a perspective view of an anchor used to attach a seat to a frame in the exercise chair embodiment of FIG. 1.

FIG. 4(*a*) is a perspective view of an alternative anchor used to attach a seat to the exercise chair frame.

FIG. 4(*b*) is an end view of the anchor shown in FIG. 4(*a*).

FIG. 5 is a side view of the exercise chair embodiment of FIG. 1 showing a person using the exercise chair in a push-up mode.

FIG. 6 is a perspective view of hand grips employed in the exercise chair of FIG. 1.

FIG. 7 is a side view of the exercise chair embodiment of FIG. 1 showing a person using the exercise chair in a sit-up mode.

FIG. 8 is a side view of the exercise chair embodiment of FIG. 1 showing a person using the exercise chair in a dip mode.

FIG. 9 is a perspective view of the exercise chair embodiment of FIG. 1 showing a person using the exercise chair in a chin-up mode.

FIG. 10(*a*) is a perspective view of an extension portion of the exercise chair embodiment of FIG. 1 in a first angular position.

FIG. 10(*b*) is a perspective view of an extension member of the exercise chair embodiment of FIG. 1 in a second angular position.

FIG. 11 is a front view of the exercise chair embodiment of FIG. 1 with supplementary weight plates attached thereto.

DETAILED DESCRIPTION OF THE INVENTION

Referring first to FIG. 1, an embodiment of an exercise chair according to the present invention comprises a frame having a first frame member 10 and a second frame member 12 disposed substantially parallel to and spaced apart from one another, and held rigidly in that position by three transversely oriented connecting members 14, 16, and 18. For purposes of description of the chair it is useful to refer to the chair as having a front 13, a back 15, a top 17, and a bottom 19. Preferably, each of the frame members has the shape of a continuous ribbon-like loop, forming respective bases 20*a* and 20*b*, back portions 22*a* and 22*b*, top portions 24*a* and 24*b*, and front portions 26*a* and 26*b*. The frames preferably also include stubs 28*a* and 28*b* for receiving a pair of respective extensions 30*a* and 30*b*. The extensions 30*a* and 30*b* fit slidably into the stubs 28*a* and 28*b* for varying the effective length of the bases 20*a* and 20*b*, respectively.

The first connecting member 14 is attached to the frames 10 and 12 proximate the top and back of the chair. The second connecting member 16 is attached to the frame at the back of the chair about midway between the top and bottom thereof. The third connecting member 18 is attached to the frame at the bottom of the chair near, but not quite at the back of the chair. Thus, the connecting members provide three non-linear points of attachment near the back of the chair, that is, the three points of attachment to each frame member are not in line with one another and therefore form a triangle. This maintains the parallel relationship of the two frame members with little lateral movement, while leaving most of the space between the two frame members open. Preferably, the frame members, connecting members, and extensions would be made of steel tubing. Also, preferably, though not necessarily, the frame members and extensions would be made of square or rectangular cross-section tubing, and the connecting members would be made of round cross-section tubing. The frame members would ordinarily be bent and welded, and the connecting members would be welded to the frame members, for the strength required for a durable exercise apparatus.

Each of the extensions 30*a* and 30*b* includes a first shaft 32 and a second shaft 34, each extending laterally from the elongate axis of its respective extension, that is, the axis along the dimension of extension running from the back to the front of the chair. Shafts 32 and 34 on each extension are disposed at right angles to one another. Each shaft 32 forms a slightly acute angle with the base of its respective frame member so as to meet the floor at a substantially right angle while supporting the front of the base spaced above the floor. Each of the shafts 34 extends perpendicularly to the longitudinal dimension of its respective extension. Thus, with the shafts 32 serving as legs for the chair, the shafts 34 point inwardly toward one another.

Referring now to FIGS. 2 and 3, as well as FIG. 1, the chair is provided with a somewhat elongate seat 36 which hangs down between the two frame members 10 and 12. The seat, which is preferably made of a fabric material such as canvas, is supported at its upper end by the first connecting member 14, over which the seat wraps. Preferably, the seat would be somewhat narrower than the inside distance between the frame members, as this avoids interference with the frame members and increases comfort.

A first seat anchor 38, which fits through a loop 40 at the back end of the seat extends across the chair and under the frame members 10 and 12. Thus, the force transmitted through the seat over the first connecting member 14 pulls upwardly on the anchor, holding the seat in place. A second seat anchor 42, which also extends across the chair, is placed through a loop 44 at the front end of the seat. The force transmitted along the seat from the weight of the seat, and of a person sitting on the seat, draws the second anchor against the front bearing surfaces of the front portions 26*a* and 26*b* of the respective frame members so as to increase friction and thereby hold the second anchor in the position at which it has been placed. To adjust the seat for comfort or posture, the user need merely lift some weight off of the seat and move the second anchor at the front of the seat up or down the front bearing surfaces until a satisfactory contour is found. Then, upon placement of all of the user's weight back upon the seat, the front of the seat will be held in place. It has been found that by forming the frame members 10 and 12 such that the front surfaces of the front portions 26*a* and 26*b* form a slightly acute angle with the bases 20*a* and 20*b*, a satisfactory friction force component along those surfaces can be created to prevent movement of the anchor once the seat is placed in a comfortable position. As can be seen from FIG. 1, the seat 36 has an overall length such that the seat anchor 42 is urged into contact with the angled front portions 26*a* and 26*b* proximate their midpoints when the seat is relaxed. Thus, the seat remains suspended between the frame members 10 and 12 even when it is not being used.

A typical anchor is shown in FIG. 3. Preferably, the anchor has a substantially rectangular cross-section with rounded front corners 46 to reduce stress concentrations, and sharp points on the chair, and notches 48 to prevent the anchors from sliding through the seat loops transversely to the chair. Although the anchors might be made of a variety of materials, it is preferred that they be made of a hard rubber substance having a metal reinforcement bar 50 embedded therein. This is because the rubber will tend to increase the frictional resistance of the anchors against the frame members, thereby reducing the tendency of the seat to move from the position in which it has been placed, while the reinforcement bar provides needed rigidity.

Alternatively, the anchor could be made as shown in FIGS. 4(*a*) and 4(*b*). A rigid bar 47, preferably having a rectangular cross section and being made, for example, of metal tubing, is provided for placement through the seat loops. Each end of the bar would be fitted with a T-shaped cap 49, the leg 51 of the T being somewhat shortened. Preferably, the cap would be made of a hard rubber, or similar substance, that would provide both rigidity and frictional resistance. When the anchor is installed in the chair, the leg 51 prevents lateral movement of the anchor and the cap provides the desired friction against the front of the frame members.

As shown in FIG. 2, the shafts 34 provide convenient footrests for a person seated in the chair. In addition, arm rests 52 can be provided on the top portion of each frame member 10 and 12 for comfort and appearance. Preferably, the arm rests would be made of some soft material, such as molded foam plastic of U-shaped cross section. The arm rests are preferably attached to the frame members by a double-sided tape selected from a variety of commonly known products, so as to avoid the use of sharp fasteners that might tear the clothing of or injure a person performing exercises. A head cushion may be provided at the top, back end of the seat by placing a piece of padding 59, such as a rectangular piece of sponge-like resilient material, in the loop 40 so as to rest on top of the first connecting member 14.

As shown in FIG. 5, the chair may be used in a push-up mode. In that case, the seat is first removed by slightly rotating the top, back portion of the seat containing the back anchor and lifting the seat out from between the frame members. The extensions 30*a* and 30*b* are adjusted longitudinally to a convenient position. The user then places his feet on, or over, one of the three connecting members 14, 16, or 18, and grasps the shafts with his hands to use them as hand grips. The user then performs deep push-up exercises by extending his arms to lift his body weight and thereafter retracting his arms. The amount of weight supported by the user's arms can be adjusted by selecting the connecting member for placement of the user's feet, and the ease of performing the exercises may be varied by varying the longitudinal positions of the extensions 30*a* and 30*b*.

FIG. 6 shows that the shafts 32 and 34 are each covered by cushioning material 54 which facilitates their use as hand grips.

In FIG. 7, the chair is shown in use in a sit-up mode. In this case the user sits with his weight supported by the first connecting member 14 at the top of the back of the chair and his feet placed behind and under the second connecting member 16 for holding his feet adjacent the back of the chair so that he can lean backward toward the front 13 of the chair and perform sit-ups from that position.

In FIG. 8 the chair is placed in position for the dip mode. The extensions 30*a* and 30*b* are moved outwardly along their longitudinal axes and held in place by respective locking pins 56*a* and 56*b* placed through aligned holes in the bases and extensions of each frame member. Thus, the extensions are placed at an intermediate position high enough for the user to perform dips without the user's feet hitting the floor. The back of the chair is placed on the floor for this purpose, with the extensions extending upwardly. The user grasps the shafts 32 on each extension to perform the dips. The shafts 32, which ordinarily act as legs, are approximately parallel to the floor and cushioned by the cushioning material 54.

As shown in FIG. 9, the extensions 30*a* and 30*b* may be moved further upwardly to extend the length of the base and are fixed in their most extreme position by the locking pins 56*a* and 56*b*. The user then grasps the shafts 34 for performing chin-ups. Although the user is shown performing narrow separation chin-ups in FIG. 9, the extensions may be rotated from their positions in FIG. 9 angularly about their elongate axes to positions 90 degrees therefrom. This enables the user to perform wide separation chin-ups by grasping the shafts 32. In this case the slightly acute angle by which the shafts 32 are attached to their respective extensions enables the user to perform chin-ups without placing his arms in an awkward position. The two positions of the extensions are shown in FIGS. 10(*a*) and 10(*b*), FIG. 10(*a*) showing the normal position of each extension, and FIG. 10(*b*) showing the extension in its rotated position. Where the preferred square tubing is employed, the change in position is accomplished by pulling each extension out of its respective base, rotating it 90 degrees, and placing it back into that base.

In performing chin-up and dip exercises it is important that the chair not tip. To this end the interior angle between the back portions 22*a* and 22*b* of the frame members and the base portions 20*a* and 20*b* should be such that the shafts 34 are aligned substantially over the center of gravity of the chair when the extensions are fully extended and the chair is on its back. When the extensions are in position for dips, they should be sufficiently close to being over the center of gravity to prevent tipping also; however, since the extensions are not extended as far, the shafts 34 need not actually be over the center of gravity in this mode.

Although, as can be seen from the aforementioned figures, the principal exercises performed with the apparatus employ the user's own weight as the source of resistance, the chair may also be used for other weight-lifting exercises. This is accomplished by sliding the extensions outwardly so as to lengthen the base of the chair and lifting up the front of the chair while grasping the shafts 34. Since the chair is preferably made of steel tubing it has substantial weight and, by itself, provides some resistance. In particular, in this mode the user can position himself between the frame members facing in the direction of extension of the extensions, squatting and grasping the shafts 34, and lifting and lowering the chair by alternately straightening and bending one or both of his legs to perform knee bending exercises, that is, "squats." By placement of one leg on top of an adjacent extension, knee bending exercises with one leg are facilitated. While in such knee bending exercises the large majority of the resistance is provided by the user's body weight, the chair may also be lifted by the shafts 34 for performing other exercises in which most of the resistance is provided by the chair, without departing from the principles of this invention.

In addition, as shown in FIG. 11, weight plates 58 may be attached to the chair to increase its weight for weightlifting exercises. To this end, rods 60 are placed into the shafts 32, each of which has a hollow center 61 (as shown in FIGS. 1 and 6) extending from one end of the shaft to the opposite side of the extension. The weight plates 58 are placed over the rods and appropriate sleeves 62 are fastened on the rods to hold the weight plates in place as is commonly known in the art. To perform close grip exercises the rods are placed into the hollow centers 61 of respective shafts from the side of the extensions opposite the protruding ends of shafts 34 for placement of the weight plates on the outside of the chair. Alternatively, to perform wide grip exercises the two extensions 30*a* and 30*b* are exchanged and the rods are placed into the shafts from their protruding ends, the weight plates being mounted adjacent those ends, as shown in FIG. 11.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. An exercise chair, comprising:

(a) a pair of frame means, disposed substantially parallel and spaced apart from one another, for supporting the chair on an underlying surface;

(b) connecting means disposed between said pair of frame means for rigidly attaching said frame means to one another;

(c) seat means for supporting a person seated on said exercise chair;

(d) anchor means for removably attaching said seat means to said frame means so as to be positioned therebetween;

(e) a pair of elongate shaft means for supporting a person performing physical exercises while said seat means is removed and a portion of said person's body resides between said frame means in the position of said seat means when attached, each of said shaft means being attached at one end thereof to one of said frame means and being unattached at the other end thereof; and (f) attachment means movably connecting said elongate shaft means to said frame means for orienting said elongate shaft means in a first position where they are directed towards one another and a second position where they are not directed towards one another.

2. The exercise chair of claim 1 wherein said frame means include respective movably attached extension means for varying the length of said frame means, said extension means being connected to respective attachment means.

3. The exercise chair of claim 2 wherein said chair has a front and a back, and said extension means are disposed so as to vary the length of respectable said frame members means from the front to the back of said chair.

4. The exercise chair of claim 2 wherein said extension means include means for permitting elongate axes of said shaft means to be placed selectively in a plurality of orientations.

5. The exercise chair of claim 1 wherein said exercise chair has a top, a bottom, a front, and a back, and said connecting means includes a first rigid member attached transversely between said pair of frame members means proximate the top and back of said chair, a second rigid member attached transversely between said pair of frame members means at the back thereof approximately midway between the top and bottom of said chair, and a third rigid member attached transversely between said pair of frame members means proximate the back and bottom thereof so as to establish three non-linear points of attachment of said frame members means to one another.

6. An exercise chair, comprising:

(a) frame means for supporting a seat, said frame means having (i) base means for supporting said chair on a surface in a first position, said base means having a front end and a back end, and (ii) back means for supporting said chair on said surface in a second position such that the front end of said base means is held above said surface, said back means being attached to said base means proximate the back end thereof;

(b) seat means detachably attached to said frame means for supporting a person in a sitting position suspended above said surface when said exercise chair is in said first position;

(c) extension means movably attached to said base means for selectively varying the distance along a dimension of extension from the back end to the front end of said base means;

(d) wherein said extension means has an elongate axis in the dimension of extension, and includes a first shaft and a second shaft, said first shaft being attached to said extension means so that its elongate axis is substantially perpendicular to the elongate axis of said extension means and said second shaft being attached to said extension means so that its elongate axis is perpendicular to the elongate axis of said first shaft, said extension means and base means including means for fixing said extension means at selected annular positions rotated about the elongate axis of said extension means.

7. An exercise chair, comprising:

(a) frame means for supporting a seat, said frame means having (i) base means for supporting said chair on a surface in a first position, said base means having a front end and a back end, and (ii) back means for supporting said chair on said surface in a second position such that the front end of said base means is held above said surface, said back means being attached to said base means proximate the back end thereof;

(b) seat means detachably attached to said frame means for supporting a person in a sitting position suspended above said surface when said exercise chair is in said first position;

(c) extension means movably attached to said base means for selectively varying the distance along a dimension of extension from the back end to the front end of said base means;

(d) wherein said extension means has an elongate axis in the dimension of extension, and including a shaft attached thereto, the elongate axis of said shaft being disposed perpendicular to the elongate axis of said extension means and comprising a tube for receiving a rod, said chair further comprising a rod for insertion into said shaft, a weight for placement on said rod, and means for fastening said weight onto said rod.

8. An exercise chair, comprising:

(a) a pair of frame members disposed substantially parallel to and spaced apart from one another and having base and front portions, the front portion of each said frame member forming an upwardly exposed bearing surface, a portion of which forms an acute angle with said base portion;

(b) back support means for rigidly interconnecting said pair of frame members; and (c) seat means for supporting a person sitting thereon, said seat means having a front end and a back end and being supporting at the back end by said back support means and having anchor means, disposed at the front end for placement against and slidable engagement with the bearing surface of each said frame member, for supporting the front end of said seat means.

9. The exercise chair of claim 8 wherein said chair has a front, a back, a top, and a bottom, and each said frame member includes a rigid ribbon of material having a first portion extending upwardly at the back of said chair, a second portion extending downwardly toward the front of said chair, a third portion extending downwardly to the bottom of said chair, and a fourth portion extending between said first and third portions, said bearing surface of each said frame member being the front surface of said third portion, said back support means comprising a rigid connecting member attached transversely between said frame members proximate the top and the back of said chair, said seat means comprising a sheet of flexible material having a front end and a back end and a loop at each end, said back end being placed over said connecting member, said anchor means comprising a first rigid bar inserted through the loop at the front end of said seat such that the ends of said rigid bar rest against respective front surfaces of said third portions of said frame members, said seat means including a second rigid bar placed through the loop in said seat at the back end thereof such that the ends of said second rigid bar rest against respective frame members on the underside of said ribbon.

10. The exercise chair of claim 8 wherein said anchor means comprises an elongate rubber bar having an elongate reinforcing member embedded therein, the ends of said rubber bar being notched such that a first portion of said rubber bar is longer than a second portion thereof, said reinforcing member extending substantially throughout the length of said longer, first portion.

11. The exercise chair of claim 8 wherein said anchor means comprises an elongate rigid bar having a rectangular cross section, each end of said rigid bar being disposed in a T-shaped cap, the leg of the T projecting perpendicularly to the elongate axis of the bar.

12. The exercise chair of claim 8 wherein said seat means comprises a sheet of fabric material.

13. The exercise chair of claim 8, further comprising a pair of armrests disposed respectively on top of each said frame member.

* * * * *